US008499536B2

(12) United States Patent
Bonneville

(10) Patent No.: US 8,499,536 B2
(45) Date of Patent: Aug. 6, 2013

(54) APPARATUSES AND METHODS FOR ASSISTED TOOLING EXTRACTION

(75) Inventor: Craig R. Bonneville, Black Earth, WI (US)

(73) Assignee: Alkar-RapidPak-MP Equipment, Inc., Lodi, WI (US)

( * ) Notice: Subject to any disclaimer, the term of this patent is extended or adjusted under 35 U.S.C. 154(b) by 499 days.

(21) Appl. No.: 12/605,171

(22) Filed: Oct. 23, 2009

(65) Prior Publication Data

US 2010/0287889 A1 Nov. 18, 2010

Related U.S. Application Data

(60) Provisional application No. 61/179,216, filed on May 18, 2009.

(51) Int. Cl.
*B65B 47/00* (2006.01)

(52) U.S. Cl.
USPC ..... 53/561; 53/559

(58) Field of Classification Search
USPC ..... 53/453–454, 559, 285, 476
See application file for complete search history.

(56) References Cited

U.S. PATENT DOCUMENTS

| | | | | |
|---|---|---|---|---|
| 3,230,869 A | | 1/1966 | Wilkins | |
| 3,808,772 A | | 5/1974 | Turtschan | |
| 4,137,784 A | | 2/1979 | Griffin | |
| 4,370,112 A | | 1/1983 | Sorbier | |
| 4,449,907 A | * | 5/1984 | Yonezawa et al. | 425/183 |
| 4,529,371 A | | 7/1985 | Nickley | |
| 4,773,839 A | | 9/1988 | Case et al. | |
| 4,894,977 A | | 1/1990 | Rittinger et al. | |
| 4,897,985 A | | 2/1990 | Buchko et al. | |
| 4,915,283 A | | 4/1990 | Buchko et al. | |
| 4,987,725 A | | 1/1991 | Gill | |
| 5,014,500 A | | 5/1991 | Robache | |
| 5,170,611 A | * | 12/1992 | Buchko et al. | 53/453 |
| 5,205,110 A | * | 4/1993 | Buchko | 53/453 |
| 5,307,610 A | * | 5/1994 | Schneider et al. | 53/559 |
| 5,443,150 A | | 8/1995 | Buchko | |
| 5,682,729 A | | 11/1997 | Buchko | |
| 5,785,270 A | | 7/1998 | Buchko | |
| 5,813,197 A | | 9/1998 | Aguzzoli | |
| 6,085,490 A | | 7/2000 | Buchko | |

(Continued)

FOREIGN PATENT DOCUMENTS

| | | |
|---|---|---|
| DE | 2 235 280 A1 | 1/1974 |
| DE | 90 10 832 U1 | 9/1990 |

(Continued)

OTHER PUBLICATIONS

Partial European Search Report for European Patent Application No. 10005159.8, having a completion date of Aug. 26, 2010.

(Continued)

*Primary Examiner* — Alexandra Elve
*Assistant Examiner* — Andrew M Tecco
(74) *Attorney, Agent, or Firm* — Andrus, Sceales, Starke & Sawall, LLP

(57) ABSTRACT

Packaging machines are disclosed including a web transport conveyor transporting a web of flexible packaging material from upstream to downstream locations through a series of stations. Packaging apparatuses are disclosed including a forming station and a closing station, each having movable die members that are counterbalanced. Methods of operating the packaging apparatus are disclosed.

12 Claims, 19 Drawing Sheets

U.S. PATENT DOCUMENTS

| | | | | |
|---|---|---|---|---|
| 6,240,706 | B1 | 6/2001 | Thomas et al. | |
| 6,523,462 | B1 | 2/2003 | Johnson et al. | |
| 6,604,452 | B2 | 8/2003 | Hanson et al. | |
| 6,843,043 | B2 | 1/2005 | Hanson et al. | |
| 6,941,729 | B2 | 9/2005 | Dal Pozzo | |
| 7,055,296 | B2 | 6/2006 | Christ | |
| 7,121,063 | B2 | 10/2006 | Haws | |
| 7,195,552 | B1 | 3/2007 | Johnson et al. | |
| 7,325,486 | B1 | 2/2008 | Nordby et al. | |
| 7,340,871 | B1 * | 3/2008 | Shackelford et al. | 53/453 |
| 7,416,479 | B2 | 8/2008 | Johnson et al. | |
| 7,458,197 | B2 | 12/2008 | Hanson et al. | |
| 7,490,448 | B1 | 2/2009 | Bonneville et al. | |
| 7,607,279 | B2 * | 10/2009 | Shackelford et al. | 53/453 |
| 7,607,973 | B1 | 10/2009 | Beld et al. | |
| 7,629,012 | B2 | 12/2009 | Karman et al. | |
| 7,703,265 | B2 * | 4/2010 | Bonneville et al. | 53/559 |
| 8,028,504 | B2 * | 10/2011 | Zeller et al. | 53/559 |
| 2004/0237474 | A1 * | 12/2004 | Gregerson et al. | 53/453 |
| 2009/0013880 | A1 | 1/2009 | Nordby et al. | |
| 2009/0100804 | A1 | 4/2009 | Bonneville et al. | |
| 2009/0104327 | A1 | 4/2009 | Pulsfus et al. | |
| 2009/0260320 | A1 | 10/2009 | Miller et al. | |

FOREIGN PATENT DOCUMENTS

| | | | |
|---|---|---|---|
| DE | 20 2004 016 538 | U1 | 2/2005 |
| DE | 10 2004 051 923 | B4 | 12/2007 |
| DE | 10 2007 062 983 | A1 | 6/2009 |
| EP | 0 467 069 | A1 | 1/1992 |
| EP | 1 234 765 | B1 | 5/2006 |
| EP | 2 110 219 | A1 | 10/2009 |
| GB | 1 184 481 | A | 3/1970 |
| WO | 2009/083200 | A1 | 7/2009 |
| WO | WO 2009083200 | A1 * | 7/2009 |

OTHER PUBLICATIONS

Extended European Search Report for European Patent Application No. 10005159.8, having a completion date of Jan. 25, 2011.

Partial European Search Report for European Patent Application No. 10005160.6, having a completion date of Aug. 26, 2010.

Extended European Search Report for European Patent Application No. 10005160.6, having a completion date of Jan. 24, 2011.

Brochure entitled "Low-Profile Plug Assist", Alkar-RapidPak, Inc., Apr. 2007.

European Search Report for European Patent Application No. 08018448.4, having a completion date of Feb. 11, 2009.

Brochure for Multivac M100 Automatic Rollstock Machine, 1984-1987 (1995), 4 pages.

Communication of a Notice of Opposition mailed Jan. 3, 2013 along with English Translation.

Document D6 cited in the Communication of a Notice of Opposition.

* cited by examiner

FIG. 14A
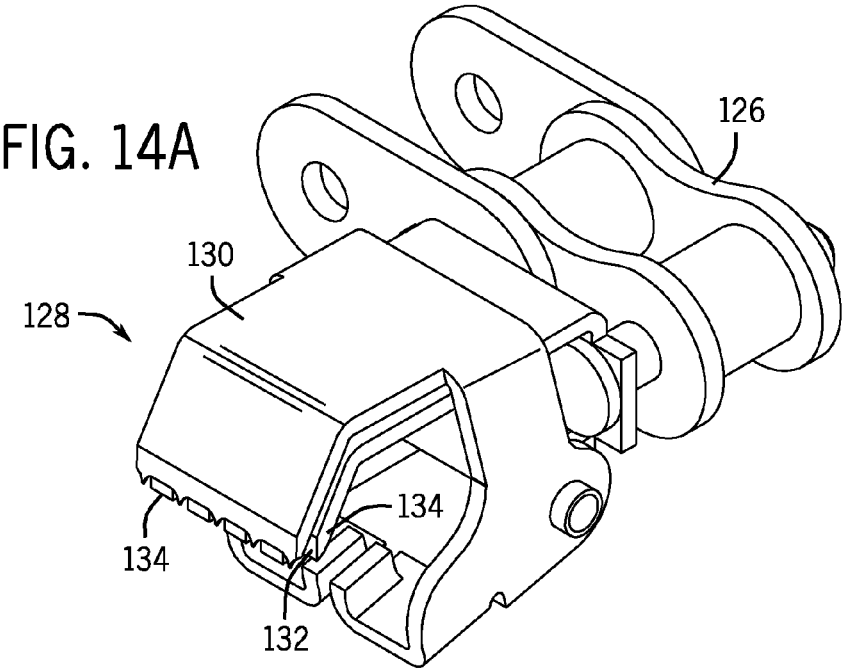
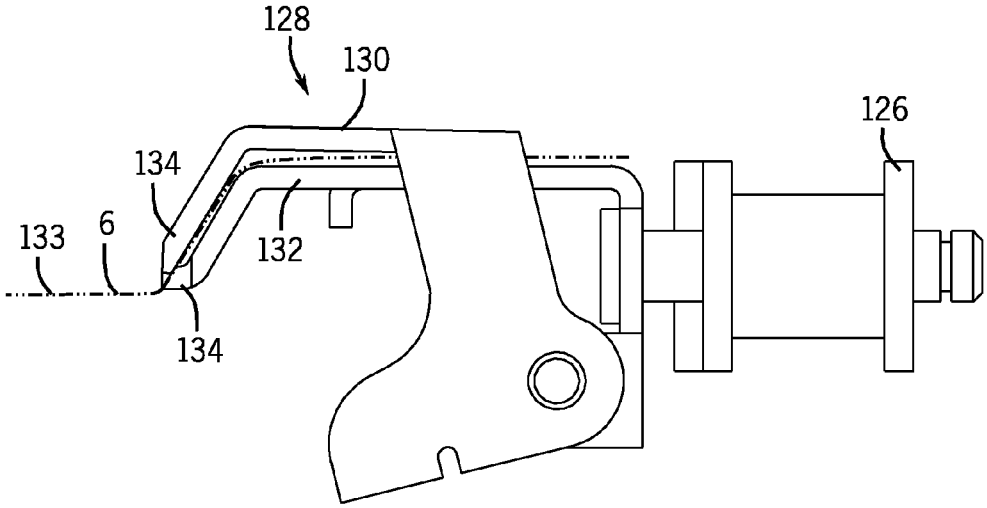
FIG. 14B

APPARATUSES AND METHODS FOR ASSISTED TOOLING EXTRACTION

CROSS-REFERENCE TO RELATED APPLICATION

The present utility patent application relates to and claims priority from U.S. Provisional Patent Application No. 61/179,216, filed May 18, 2009, the entire disclosure of which is incorporated herein by reference.

FIELD AND BACKGROUND

The present application discloses machines and methods for packaging.

U.S. Pat. No. 4,915,283 discloses a clamping arrangement for gripping and carrying web material about a turret of a packaging machine.

U.S. Pat. No. 5,205,110 discloses an indexing motion apparatus and method.

U.S. Pat. No. 7,340,871 discloses a web packaging system providing access and changing of tooling.

BRIEF DESCRIPTION OF THE DRAWINGS

Reference is made herein to the following drawing figures:

FIG. 14A is a perspective view of a gripper clip for gripping a web of flexible packaging material.

FIG. 14B is a side view of the gripper clip depicted in FIG. 14A.

DETAILED DESCRIPTION OF THE DRAWINGS

In the present application, certain terms have been used for brevity, clearness and understanding. No unnecessary limitations are to be implied therefrom beyond the requirement of the prior art because such terms are used for descriptive purposes only and are intended to be broadly construed. The different structures and systems described herein may be used alone or in combination with other structures and systems. Various equivalents, alternatives, and modifications are possible within the scope of the appended claims. In the appended claims, the inventors intend to invoke interpretation under 35 USC 112, sixth paragraph in a particular claim only where the terms "means" and "for" are used in that claim. Otherwise, interpretation of the claims under section 112, sixth paragraph is not intended.

Figure 1:
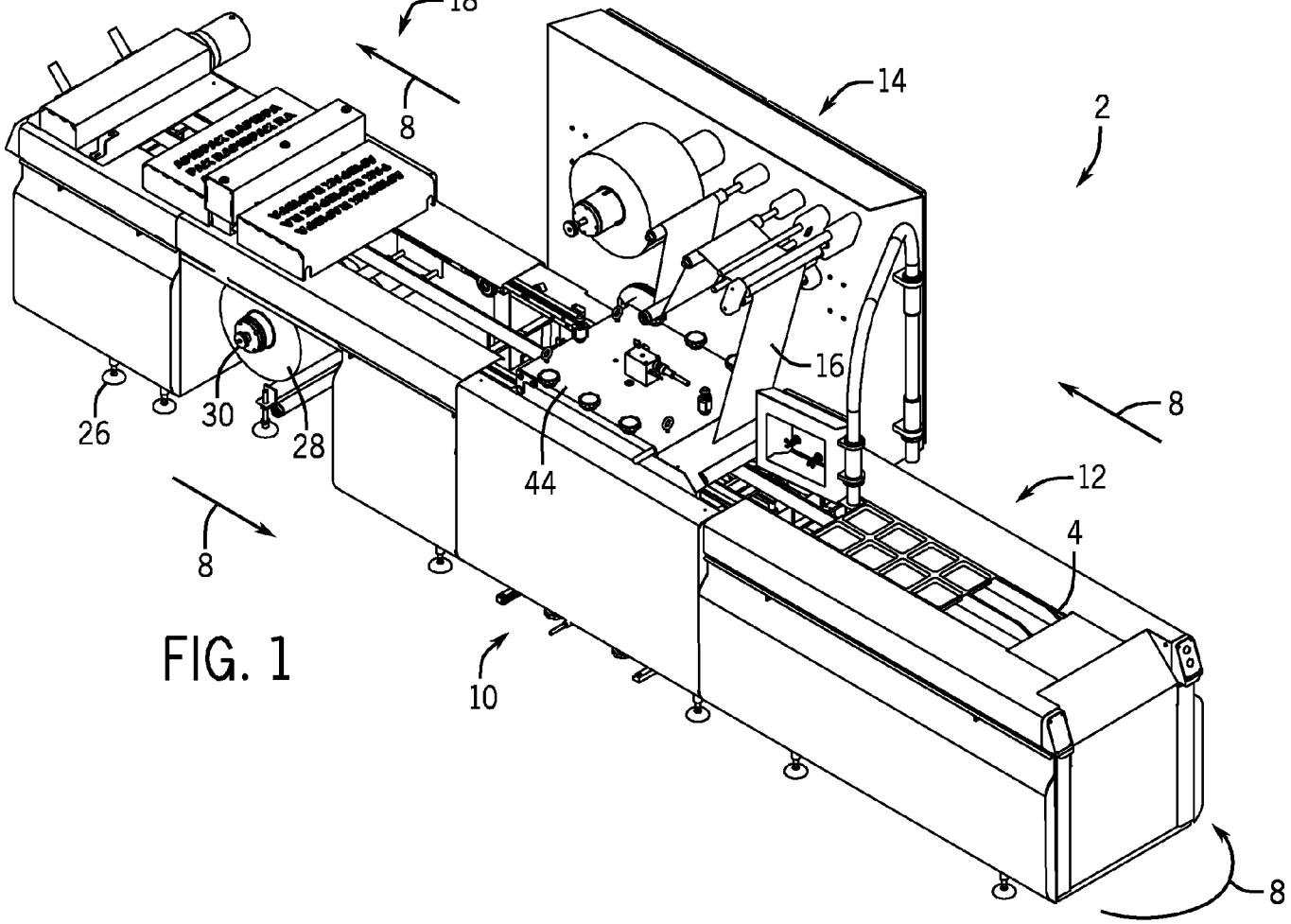
FIG. 1 depicts a web packaging machine.
Figure 2:
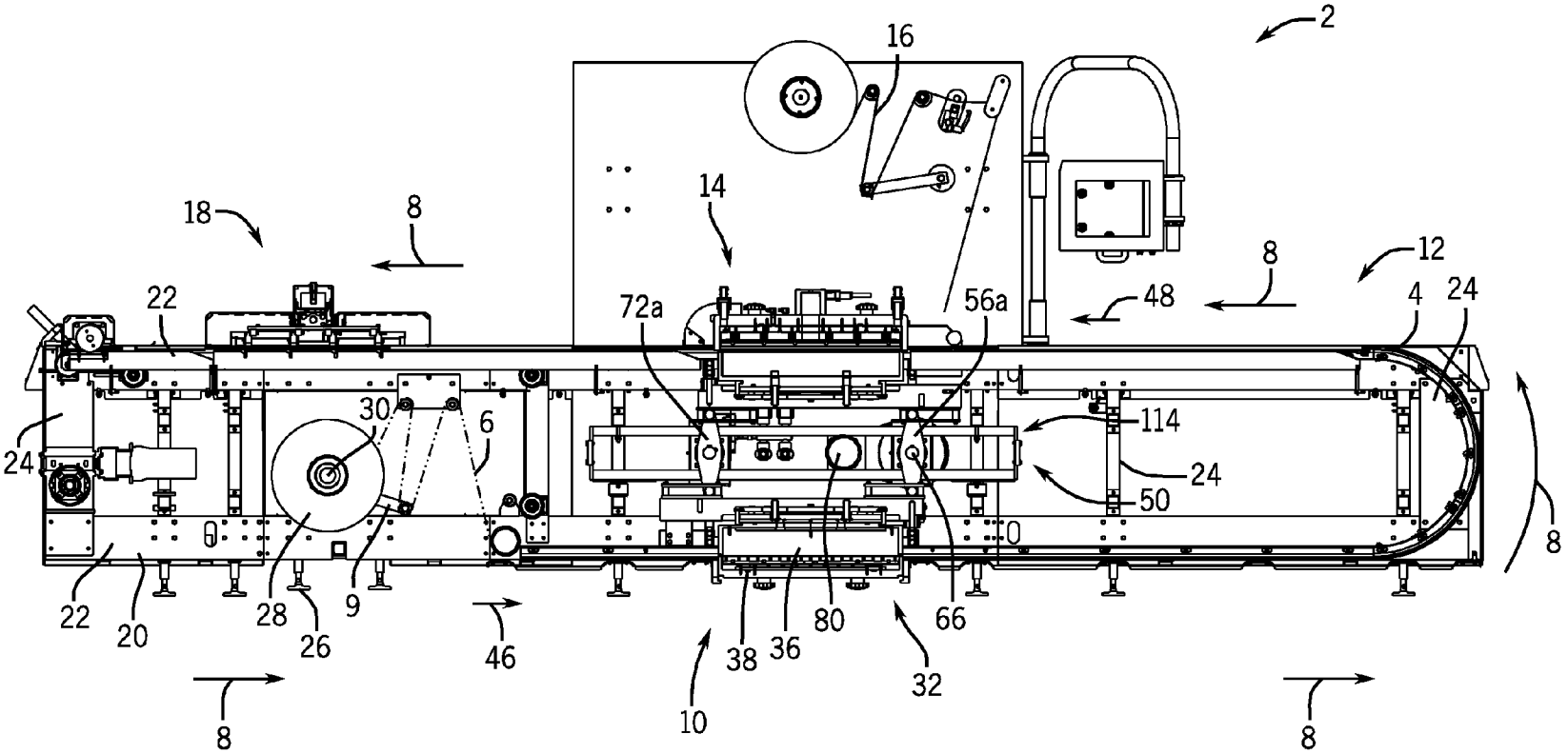
FIG. 2 is a side sectional view of the machine depicted in FIG. 1.

FIGS. 1 and 2 depict an indexing motion packaging machine 2 that includes a web transport conveyor 4 transporting a web 6 of flexible packaging material along a direction of transport depicted by arrows 8 from upstream to downstream locations through a series of stations including a forming station 10 for forming at least one pocket in the web 6, a loading station 12 for placing food product in the pocket and a closing station 14 for closing the pocket with another web 16 of flexible packaging material. In the example depicted, the machine 2 also includes a cutting station 18 for separating the closed pockets into individual food containing packages.

As depicted in FIG. 2, the various components of machine 2 are mounted to and supported by a frame 20 including spaced parallel upper and lower frame members 22 and vertical frame members 24. A series of legs, e.g. 26, support machine 2 above the ground. A supply roll 28 supplies the web 6. The supply roll 28 rotates about an unwind shaft 30 to supply the web 6 along the direction 8. An unwind motor (not shown) drives a set of rollers and a timing pulley 9 to safely pull the web 6 from the supply roll 28 and along the conveyor 4 in an indexing manner and to allow a series of operations at the forming station 10, loading station 12, closing station 14, and cutting station 18 for creating a packaged product. The operation of the supply roll 28 is similar to the operation of the supply roll arrangement depicted in U.S. Pat. No. 5,205,110. For brevity, further description of the supply roll 28 and its functions are not provided herein. It will be understood by those skilled in the art that any arrangement for safely supplying a web of flexible packaging material along a web transport direction is suitable for use with the presently described embodiments.

FIGS. 3-8 depict packaging apparatus 32 that is incorporated in the machine 2 shown in FIGS. 1 and 2. The apparatus 32 includes a forming station 10 that includes first and second forming die members 36, 38 that mutually cooperate to form a pocket in the web 6, In the embodiment shown, the first forming die member 36 includes a die box connected to a vacuum supply for vacuum forming the pocket in the web 6. The forming die member 36 is movable away from and towards the forming die member 38 between an open position (see FIG. 6) to allow movement of the web 6 in the direction 8 and a closed position (see FIG. 7), wherein the forming die member 36 engages with the forming die member 38 to sandwich the web 6 therebetween and receive a vacuum to assist in formation of the noted pocket in the web. Vacuum forming of a web is described in U.S. Pat. No. 5,205,110. It will be understood by those skilled in the art that arrangements other than that disclosed in U.S. Pat. No. 5,205,110 for forming a pocket in the web 6 are suitable for use in combination with the presently described embodiments and in addition to or instead of the arrangement described in U.S. Pat. No. 5,205,110. In addition, although the forming station 10 depicted and described includes a forming die member 36 that is movable relative to a stationary forming die member 38, those skilled in the art will recognize that the forming station 10 could instead include forming die members 36, 38 that are both movable relative to each other.

The apparatus 32 also includes a closing station 14 including first and second closing die members 42, 44, which mutually cooperate to close the noted pocket in the web with a second web 16 of flexible packaging material. In the embodiment shown, the closing die member 42 includes a die box that cooperates with a heat sealing mechanism to seal the web 16 to the web 6 in a manner similar to that described in U.S. Pat. No. 5,205,110. Closing die member 42 is movable relative to closing die member 44 between an open position (FIG. 6) to allow movement of the web 6 in the direction 8 and a closed position (FIG. 7) to close the pocket with the web 16. Operation of closing station is more fully in U.S. Pat. No. 5,205,110. It will be understood by those skilled in the art that arrangements similar to that shown in U.S. Pat. No. 5,205,110 for closing the pocket with the web 16 are suitable for use in combination with the presently described embodiments and in addition to or instead of the arrangement described in U.S. Pat. No. 5,205,110. Although the embodiment describes above includes a closing die member 42 that is movable relative to a stationary closing member 44, those skilled in the art will recognize that instead the closing station 14 could instead include closing die members 42, 44 that are movable relative to one another.

In the embodiment shown, the forming die member 36 and the closing die member 42 are counterbalanced so that movement of one of these members towards its closed position assists movement of the other one of these members towards its closed position, and so that movement of one of these members towards its open position assists movement of the other one of these members towards its open position. The counterbalanced interrelationship between the die members 36, 42 can be accomplished in different ways. In the embodiment shown, the forming die member 36 is inverted with respect to the closing die member 42, and the forming station 10 is located below the closing station 14 in the machine 2. In this respect, the forming station 10 and closing station 14 are oriented such that the web 6 enters the forming station 10 from one direction shown at arrow 46 and enters the closing station 14 from another, opposite direction shown at arrow 48. Counterbalancing between the forming die member 36 and closing die member 42 is facilitated by a first lift 50 operatively connected to both the forming die member 36 and closing die member 42. The first lift 50 can include different mechanisms that facilitate counterbalanced, driven motion between the respective die members 36, 42, and so that movement of the first lift 50 moves the forming die member 36 towards its closed position and the closing die member 42 toward its closed position, and so that opposite movement of the first lift 50 moves the forming die member 36 towards its open position and the closing die member 42 towards its open position.

In the embodiment shown, the respective die members 36, 42 are inverted with respect to each other and the first lift 50 is disposed between the forming station 10 and the closing station 14. The first lift 50 is located vertically higher than the forming station 10 and vertically lower than the closing station 14. In operation, the first lift 50 rotates in a first direction shown in FIG. 7 at arrow 52 to move the respective die members 36, 42 away from each other as shown by arrows 51 and towards their respective closed positions. The first lift 50 rotates in a second, opposite direction show in FIG. 6 at arrow 54 to move the respective die members 36, 42 towards each other as shown by arrows 53 and towards their respective open positions.

Figure 6:
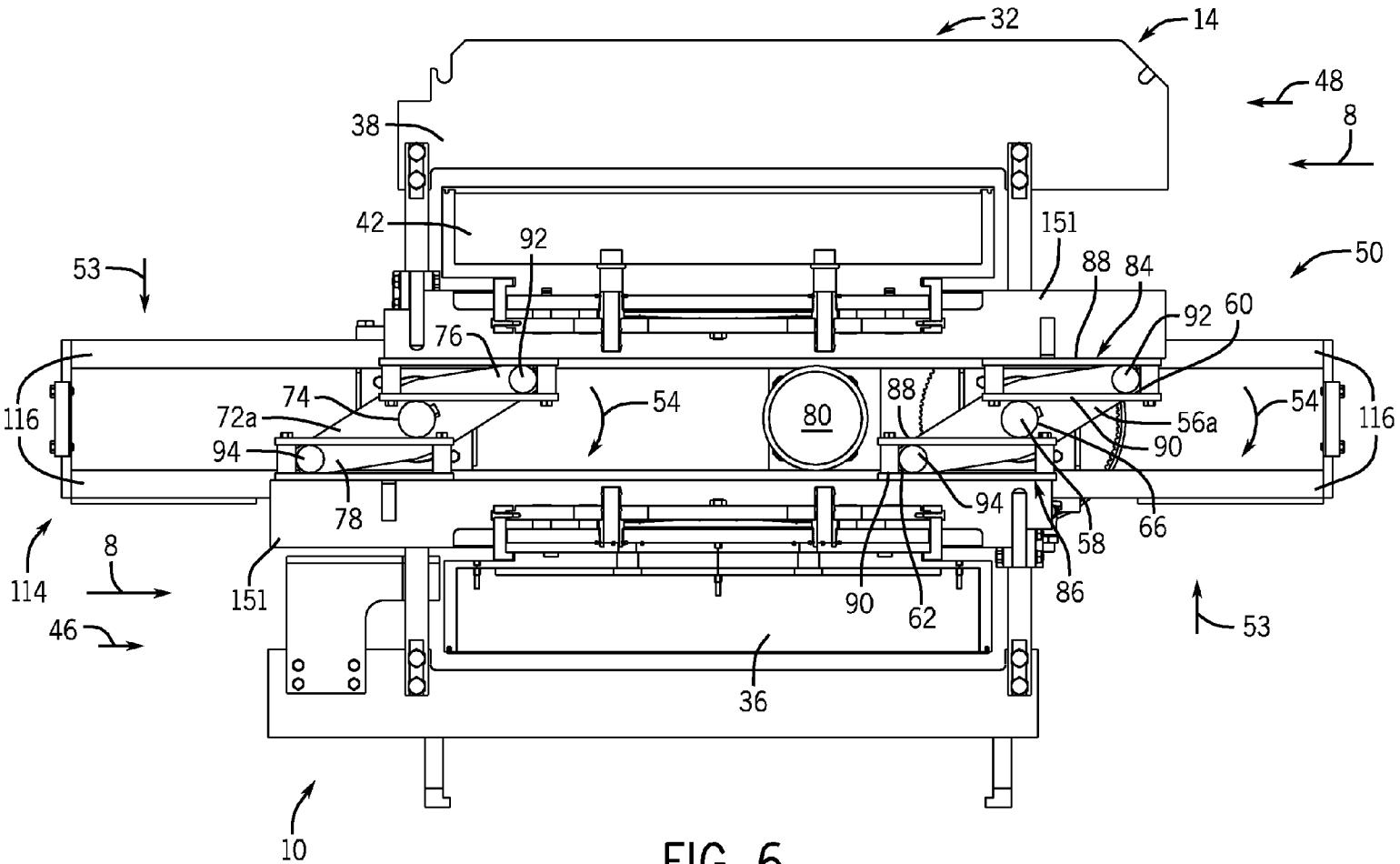
FIG. 6 is a side sectional view of the apparatus in FIG. 5, depicting movable forming and closing die members in open positions, respectively.
Figure 7:
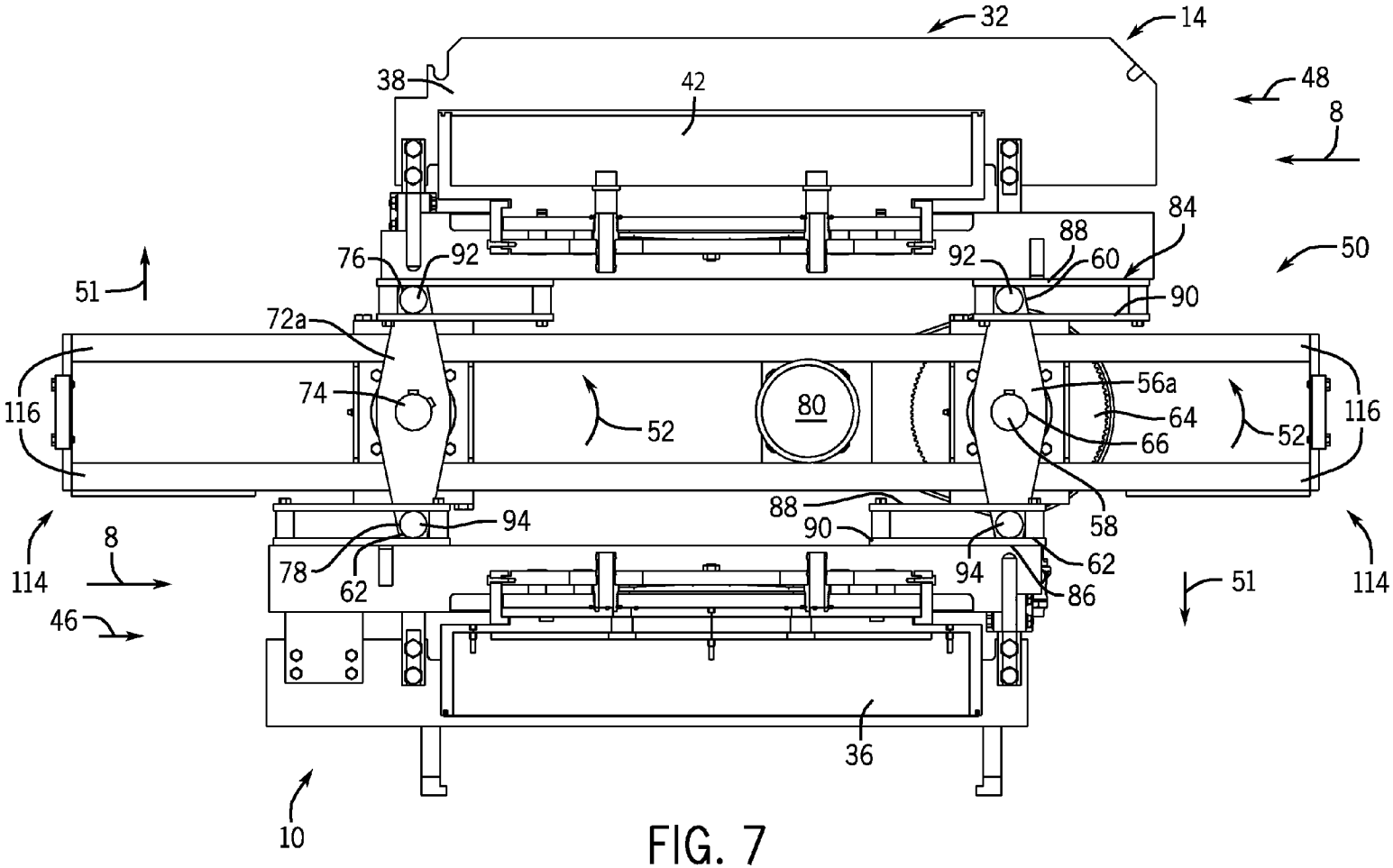
FIG. 7 is a side sectional view of the apparatus in FIG. 5, depicting movable forming and closing die members in closed positions, respectively.
Figure 8:
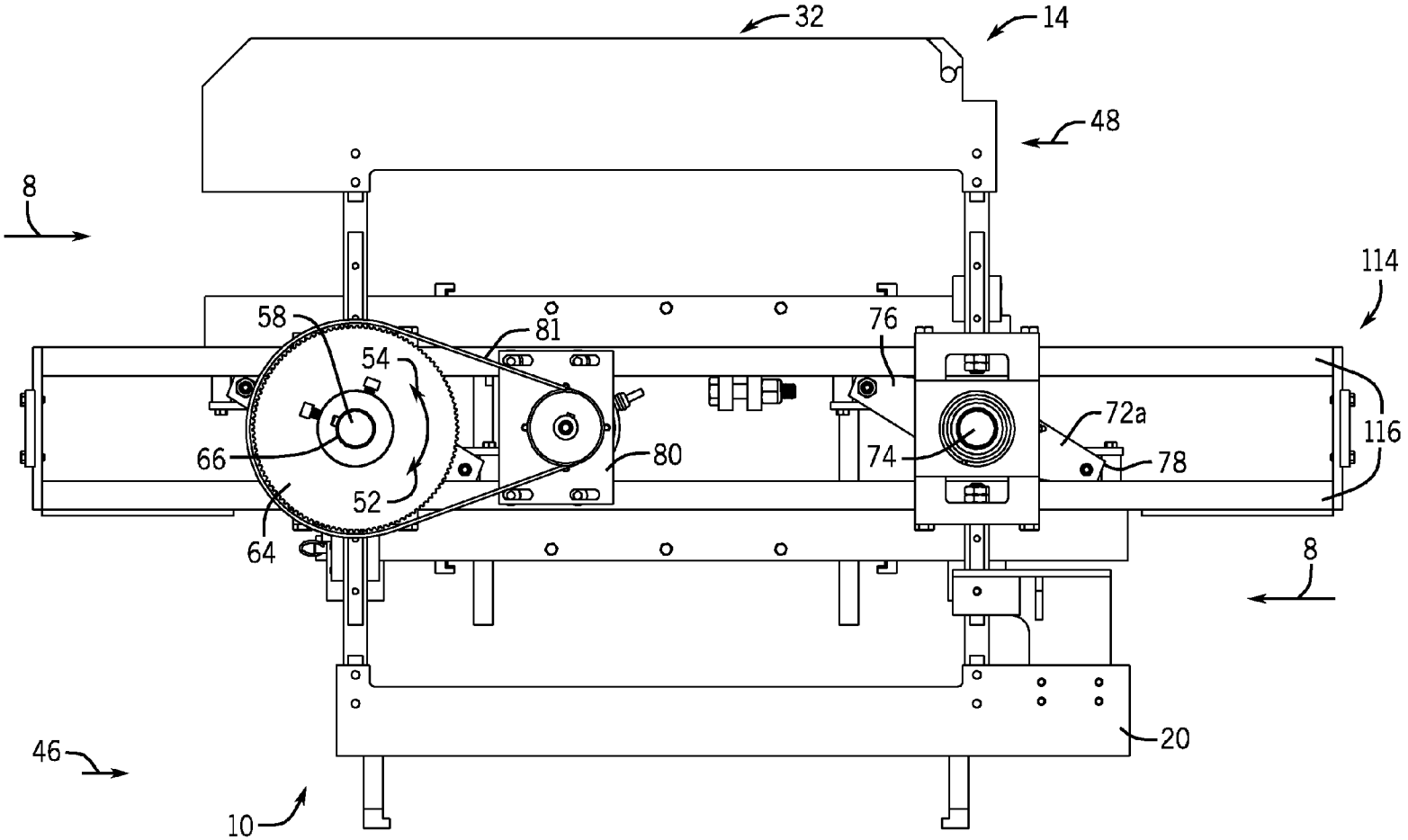
FIG. 8 is a rear view of the apparatus depicted in FIGS. 2-7.

Movement of first lift 50 facilitates counterbalanced motion between the respective die members 36, 42. In the embodiment shown, the first lift 50 includes a pair of drive arms 56*a*, 56*b* (see FIGS. 5 and 4, respectively). With reference to FIGS. 6 and 7 showing a sectional view of the apparatus 32 and depicting only drive arm 56*a*, each drive arm 56*a*, 56*b* rotates about a pivot axis 58 and has a first end 60 operatively connected to the closing die member 42 and a second, opposite end 62 operatively connected to the forming die member 36. As shown in FIG. 8, the first lift 50 also includes a drive wheel 64 operatively connected to the drive arms 56*a*, 56*b*. This can be accomplished in different ways. In the embodiment shown, the drive wheel 64 is attached to a rotatable shaft 66, which extends along the axis 58. The drive arms 56*a*, 56*b* are keyed to the shaft 66 and thus rotate concentrically and along with rotation of the drive wheel 64. Rotation of the drive wheel 64 thus causes rotation of the drive arms 56*a*, 56*b* about the axis 58 and, as described further below, causes movement of the closing die box 42 and the forming die box 36 into and out of the respective open and closed positions.

In the embodiment shown, the first lift 50 also includes a follower wheel 68 (see FIG. 4) that is operatively connected to the drive wheel 64 so that rotation of the drive wheel 64 causes rotation of the follower wheel 68. Connection of the follower wheel 68 to the drive wheel 64 can be accomplished in different ways. In the example shown the connection is accomplished by a belt 70 that operatively connects the follower wheel 68 to the rotatable shaft 66, which in turn is connected to the drive wheel 68.

A pair of follower arms 72*a*, 72*b* (see FIGS. 5 and 4, respectively) are operatively connected to the follower wheel 68 so that rotation of the follower wheel 68 causes rotation of the follower arms 72*a*, 72*b*. Rotation of the follower arms 72*a*, 72*b* can be accomplished in different ways, and in the example shown is accomplished by connection of the follower wheel 68 to a rotatable shaft 74 to which the follower arms 72*a*, 72*b* are keyed so that the follower arms 72*a*, 72*b* rotate concentrically and along with the follower wheel 68. With reference to FIGS. 6 and 7 showing sectional views of the apparatus 32 and depicting only follower arm 72*a*, each follower arm 72*a*, 72*b* has a first end 76 operatively connected to the movable first closing die member 42 and a second, opposite end 78 operatively connected to the forming die member 36. As explained further below, rotation of the follower arms 72*a*, 72*b* causes movement of the closing die member 42 and the forming die member 36 into and out of the open and closed positions.

A servo motor 80 is connected to the drive wheel 64 by a belt 81 (see FIG. 8) and operatively drives the drive wheel 64 into rotation in a back and forth direction shown at arrows 52, 54. This causes rotation of the rotatable shaft 66 about axis 58, which in turn causes drive arms 56*a*, 56*b* to rotate back and forth between the positions shown in FIGS. 6 and 7. Rotation of the drive wheel 64 is translated to follower wheel 68 via belt 70 and thus causes rotation of follower wheel 68 in the same timing and orientation. Rotation of follower wheel 68 causes rotation of follower arms 72*a*, 72*b* back and forth between the positions shown in FIGS. 6 and 7.

Referring now to FIGS. 6 and 7, respectively, pivoting movement of the drive arms 56*a*, 56*b* and follower arms 72*a*, 72*b* causes movement of the die members 36, 42 into and out of the noted open and closed positions. This can be accomplished in different ways. In the example shown, the first ends 60 of the drive arms 56*a*, 56*b* travel along guide tracks 84 operatively connected to the closing die member 42 and the second ends 62 of the drive arms 56*a*, 56*b* travel along guide tracks 86 operatively connected to the forming die member 36. Both of the guide tracks 84, 86 include first and second rails 88, 90. Bearings 92 are operatively connected to each of the first ends 60 of the drive arms 56*a*, 56*b*, and are disposed between and configured to ride along the rails 88, 90 of the guide track 84. Bearings 94 are operatively connected to the second ends 62 of the drive arms 56*a*, 56*b* and are disposed between and configured to ride along the rails 88, 90 of the guide track 86.

Follower arms 72*a*, 72*b* also have bearings 92, 94 that ride in guide tracks 84, 86 including rails 88, 90. The structure and operation of the follower arms 72*a*, 72*b* is thus driven by and follows the operation of the drive arms 56*a*, 56*b*. Operation of the servo motor 80 thus causes rotation of both the drive arms 56*a*, 56*b* and the follower arms 72*a*, 72*b* to move the movable die members 36, 42 into and out of the open and closed positions shown in FIGS. 6 and 7, respectively. Specifically, rotation of the drive arms 56*a*, 56*b* causes bearings 94 to ride along rails 88, 90 and push the forming die member 36 and closing die member 42 into and out of the open and closed positions. In the same way, rotation of the follower arms 72*a*, 72*b* causes bearings 92, 94 to ride along rails 88, 90 and push the forming die member 36 and closing die member 42 into and out of the open and closed positions.

Figure 11:
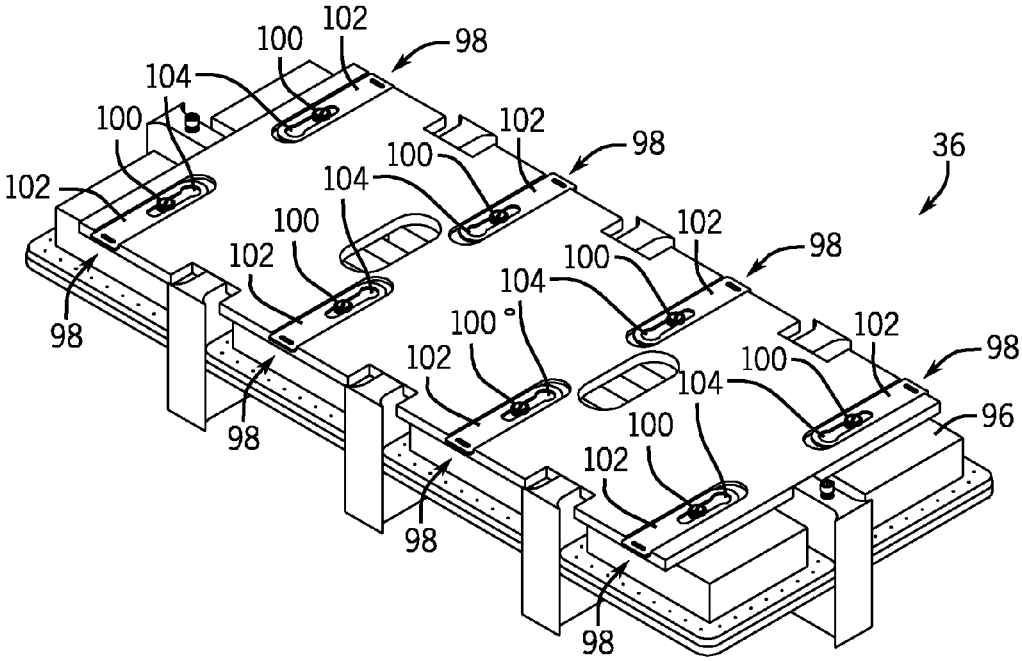
FIG. 11 is a perspective view of an inverted die box, form insert, and latches releasably retaining the form insert in the die box.
Figure 12:
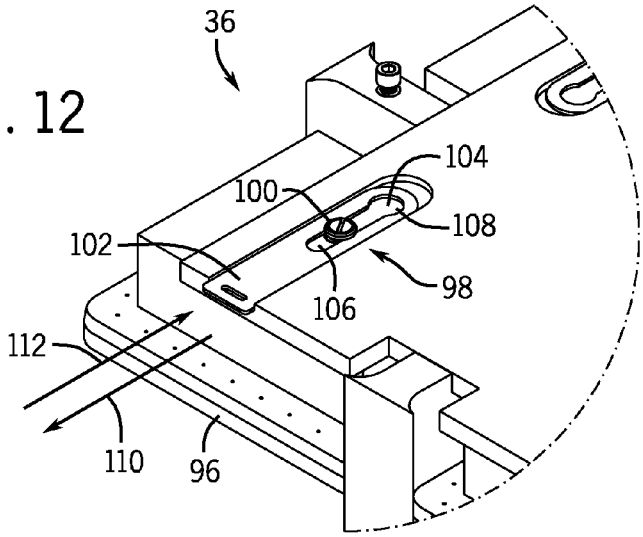
FIG. 12 is a detail view of a latch releasably retaining the form insert in the die box.

In the embodiment shown, the forming die member 36 is oriented upside-down in the packaging apparatus 32, such that the forming die member 36 is inverted with respect to the closing die member 42. Referring to FIGS. 11 and 12, a form insert 96 is releasably retained with the rest of forming die member 36 by a plurality of latches 98. Latches 98 can include different latching configurations to provide a releasable connection of the form insert 96 to the rest of forming die member 36. In the example shown, latch 98 includes a locking pin 100 releasably engaged in a pull tab 102 defining a recess 104 that includes a slot 106 and key hole 108. Referring to FIG. 12, the form insert 96 is shown in its attached position. Release of the form insert 96 is accomplished by pulling tab 102 in the direction of arrow 110 until the head of pin 100 is aligned with key hole 108. Key hole 108 is sized slightly larger than the head of pin 100 and thus the pin 100 is allowed by the force of gravity to pass through the key hole 108. Attachment of the form insert 96 is accomplished by following the above described procedure in reverse. The pin 100 is inserted into the key hole 108 and the tab 102 is slid inward in the direction of arrow 112 until the pin is aligned in slot 106, which is sized slightly smaller than the head of pin 100, thus retaining the form insert 96 in position. The above steps are repeated for each latch 98 in the plurality to selectively attach or detach the form insert 96 to the rest of forming die member 36.

Embodiments of a packaging apparatus 32 are thus depicted and described that includes a movable forming die member and movable closing die member that are counterbalanced so that movement of one of the die members towards its closed position assists movement of the other die member towards its closed position. In the example shown, the weight of the closing die member 42 acts upon the first lift 50 and thereby assists in rotation of the drive arms 56*a*, 56*b* and follower arms 72*a*, 72*b*, which thereby causes counterbalanced upward movement of the forming die member 36. Conversely, the weight of forming die member 36 acts upon the first lift 50 and thereby assists and causes rotation of the drive arms 56*a*, 56*b* and follower arms 72*a*, 72*b*, which in turn causes upward movement of the closing die member 42.

In the example shown, the first lift 50 is operatively connected to and counterbalances the forming die member 36 and the closing die member 42. Movement of the first lift 50 moves the forming die member 36 towards its closed position and the closing die member 42 towards its closed position. Opposite movement of the first lift 50 moves the forming die member 36 towards its open position and the closing die member 42 towards its open position.

Again, although the present embodiment includes the above-described configuration for generating rotational motion of the lift, and counterbalanced motion of the forming station and sealing station, various other alternative embodiments could be employed in combination with or in addition to the lift shown and described, forming station embodiment, and closing station embodiments described. For example, the lift could also or alternatively include a wheel disposed laterally between adjacent movable die members (36*a*, 42*a*) and connected thereto by, for example a rack and pinion connection. Rotation of the rotational member in one direction would move one of the members up and the other member down, and vice versa. In a similar way, such an arrangement would achieve substantially similar function and similar results.

During operation, the web 6 is indexingly moved through the machine 2 by the conveyor 4 along the direction 8, and through the forming station 10, loading station 12, closing station 14, and cutting station 18, in a similar manner as that described in U.S. Pat. No. 5,205,110. As the web 6 enters the forming station 10 in direction of arrow 46 for formation of the noted pocket, a downstream portion of the web 6 simultaneously enters the closing station 16 at arrow 48 for closing with the web 6 pocket with the web 16. The respective indexed progressions occur in a synchronized manner such that formation at the forming station 10 occurs simultaneously with closing at the closing station 14 according to the above-described driven, counterbalanced movement of the respective die members 36, 42, into and out of the positions depicted in FIGS. 6 and 7.

Figure 9A:
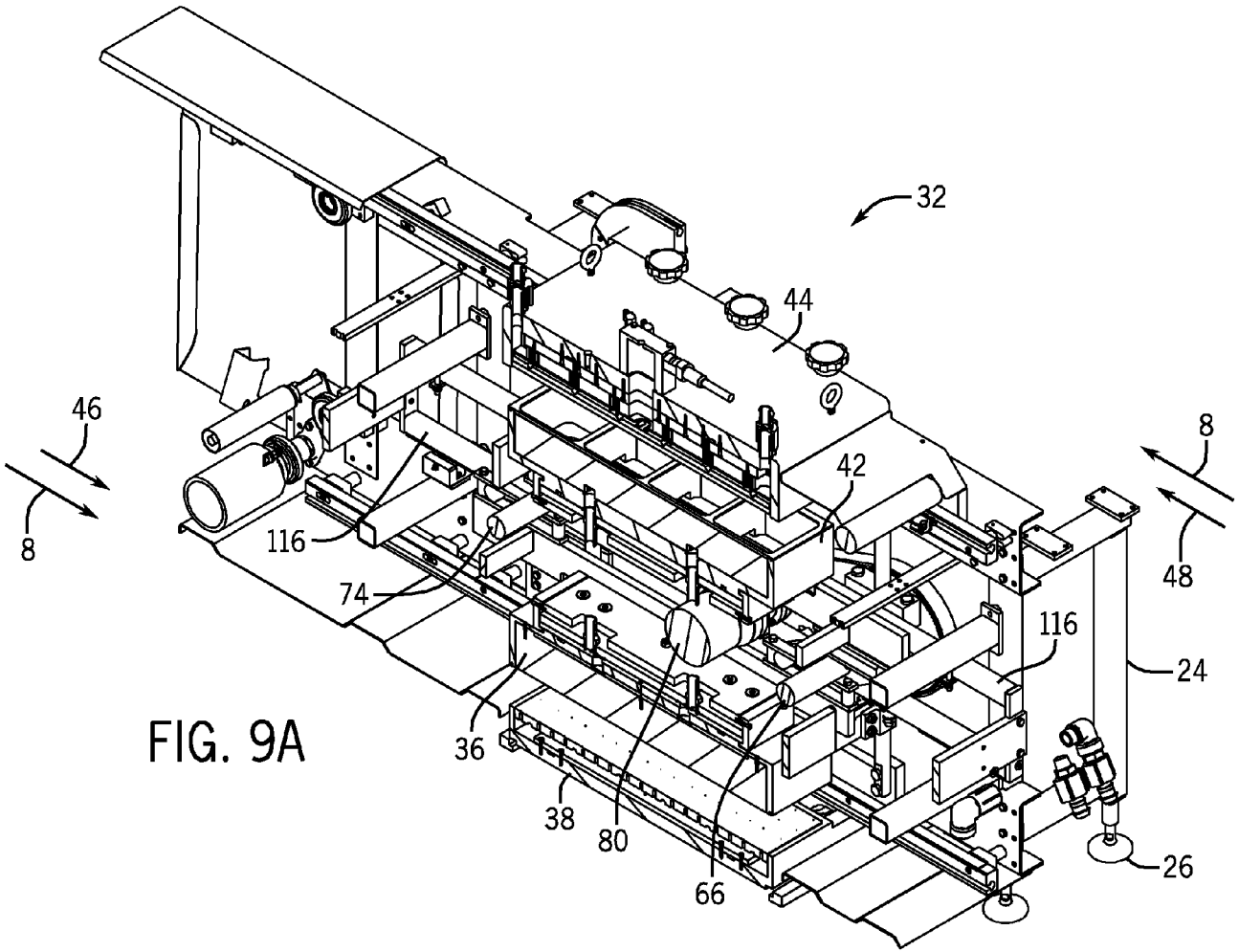
FIG. 9A is a perspective sectional view of the apparatus depicted in FIGS. 2-7, further depicting a supporting frame.
Figure 9B:
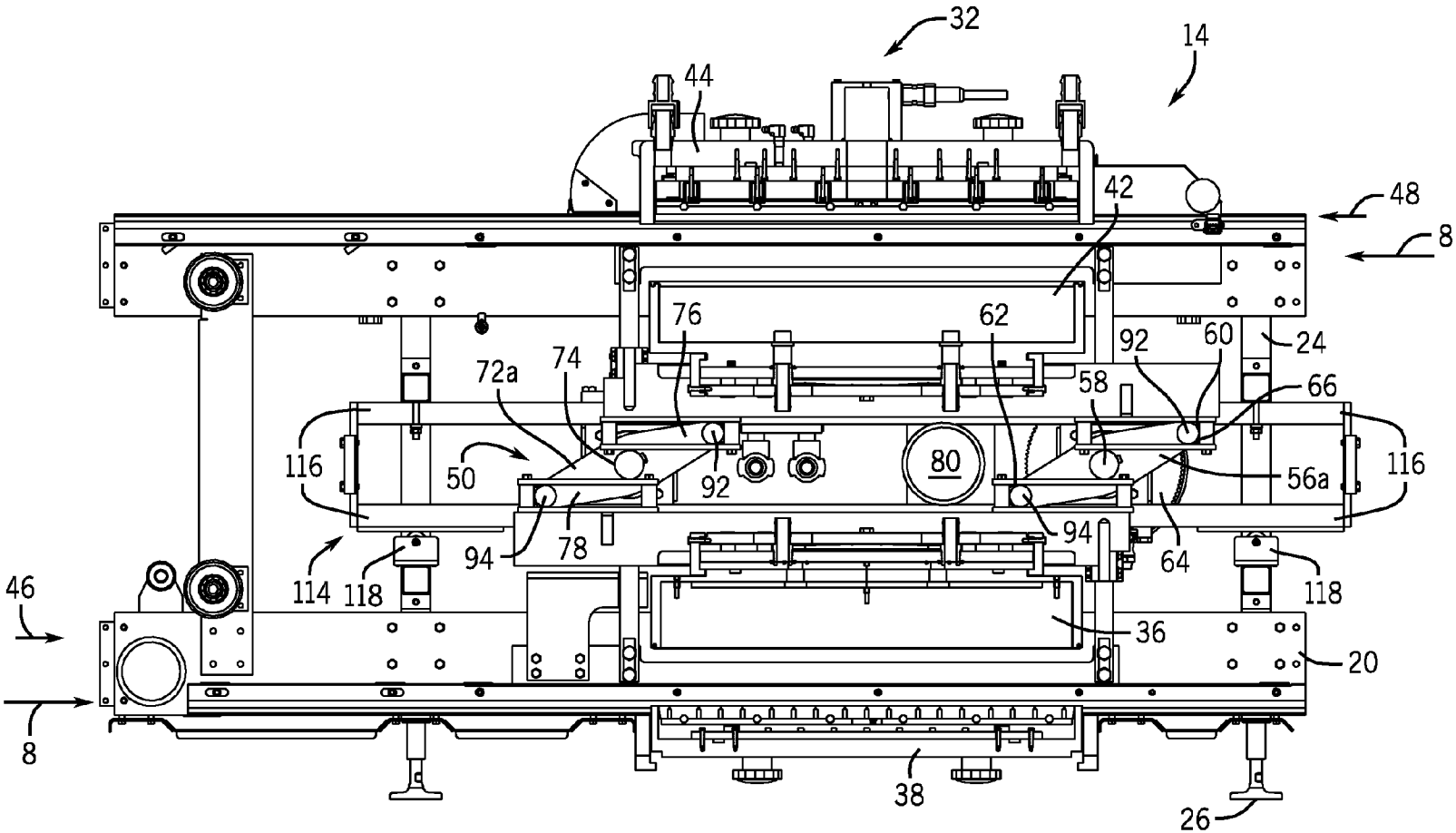
FIG. 9B is a side sectional view of the apparatus depicted in FIG. 9A.
Figure 10:
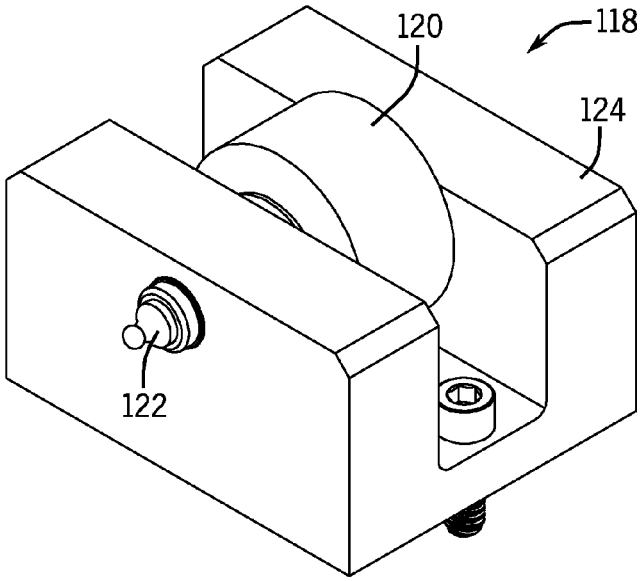
FIG. 10 is a perspective view of a roller configured to ride on the supporting frame.

Referring to FIGS. 9*a*, 9*b* and 10, the apparatus 32 is laterally movable with respect to the machine 2 along the web transport direction 8. Specifically, the packaging apparatus 32 includes a frame 114 (see FIG. 3 for perspective view) that supports the forming station 10 and closing station 14 so that the stations 10, 14 are movable together with respect to the packaging machine 2 in a direction substantially parallel to the direction of travel of the web 8. The frame 114 can include different arrangements, and in the embodiment shown includes a series of rails 116 upon which the forming station 10 and closing station 14 are supported. A plurality of rollers 118 (shown in detail in FIG. 10) are attached to the apparatus 32 and ride on the rails 116 of the frame 114 and thus movably support the forming station 10 and closing station 14 at different positions in the machine 2 laterally along the direction 8. In the embodiment shown, the rollers 118 include a wheel 120 rotatably journalled about an axle 122 that is supported on housing 124 attached to the apparatus 32. Lateral movement of the frame 114 allows the apparatus to properly function with form inserts 96 having different index lengths. Specifically, the apparatus 32 can be moved laterally along the direction 8 to a preselected position chosen based upon the particular index length of a chosen form insert 96, and so that the distance from a selected point in the forming station 10 to a selected point in the closing station 14 remains divisible by a perfect number regardless of the particular index length of the form insert 96 installed in the forming station 10. This allows for indexed motion and simultaneous operation of the forming station 10 and closing station 14 with different form inserts having different index lengths.

Figure 13:
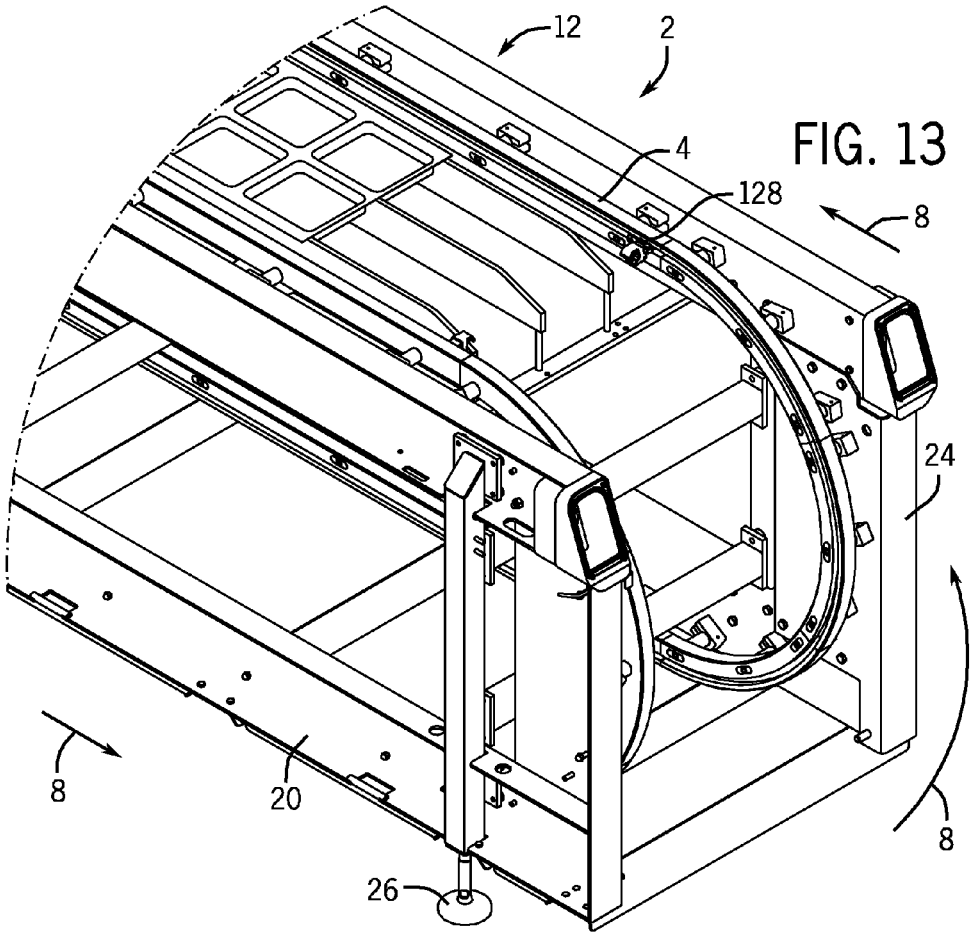
FIG. 13 is a partial perspective sectional view of a turret.

FIGS. 13, 14*a* and 14*b* depict a clamping arrangement for gripping and carrying the web 6 in the web transport direction 8. The clamping arrangement includes a plurality of clamps 128 configured substantially in accordance with the arrangement described in U.S. Pat. No. 4,915,283. A pair of aligned opposing drive chains 126 are configured to travel about a set predetermined path within the packaging machine 2. A plurality of clamps 128 are fastened to the chains 126 at fixed distances from one another such that the clamps 128 on one chain 126 are directly aligned with and face the clamps 128 on the opposing chain 126. Each clamp 128 includes first and second jaw members 130, 132, a biasing spring, and associated attachment mechanism, as described in U.S. Pat. No. 4,915,283. Teeth 134 are formed on the jaw members 130, 132 and are aligned in the plane of the pitch line 133 of the respective drive chains 126. This configuration allows for travel of the web 6 around turret 136 on the packaging machine 2 to reverse movement of the transport conveyor 4 to allow for movement of the web 6 in the opposite directions of arrows 46, 48, without stretching or breakage of the web 6 and pockets formed therein during movement about turret 136.

Figure 15:
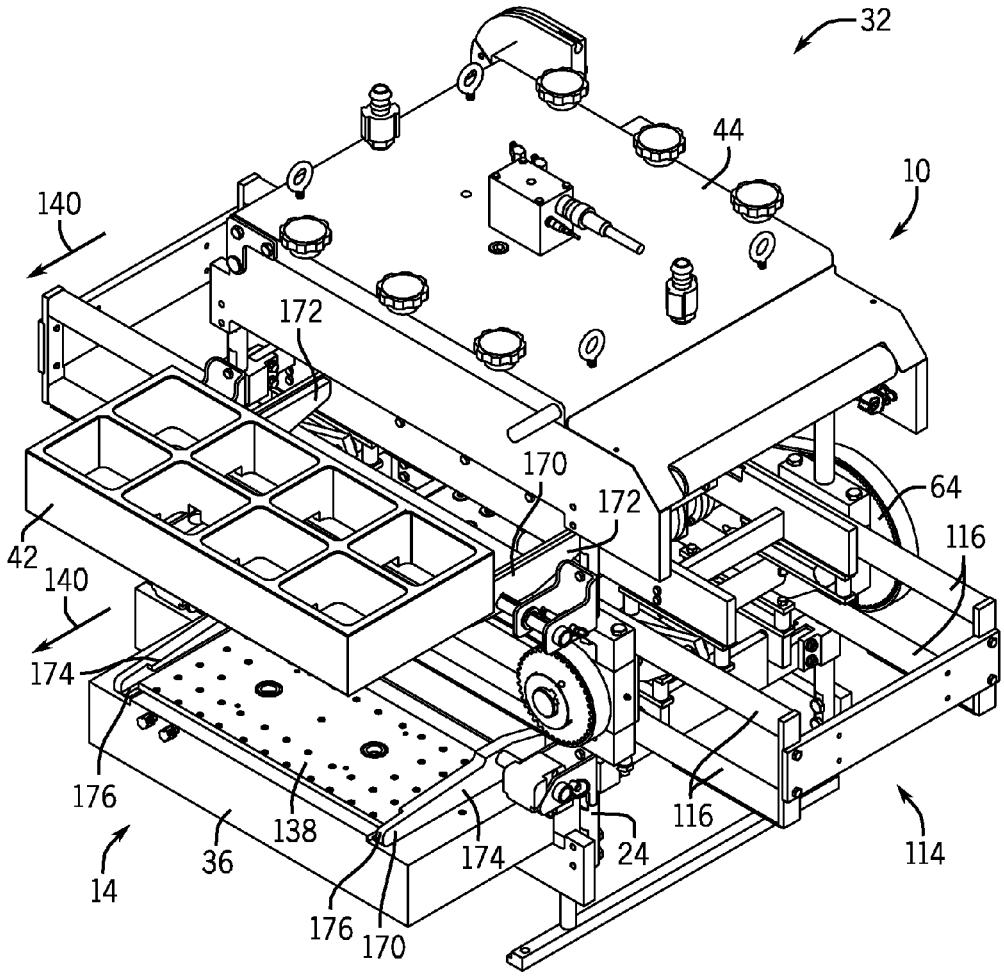
FIG. 15 is a perspective view of movable forming and sealing die members moved into extracted positions.
Figure 16:
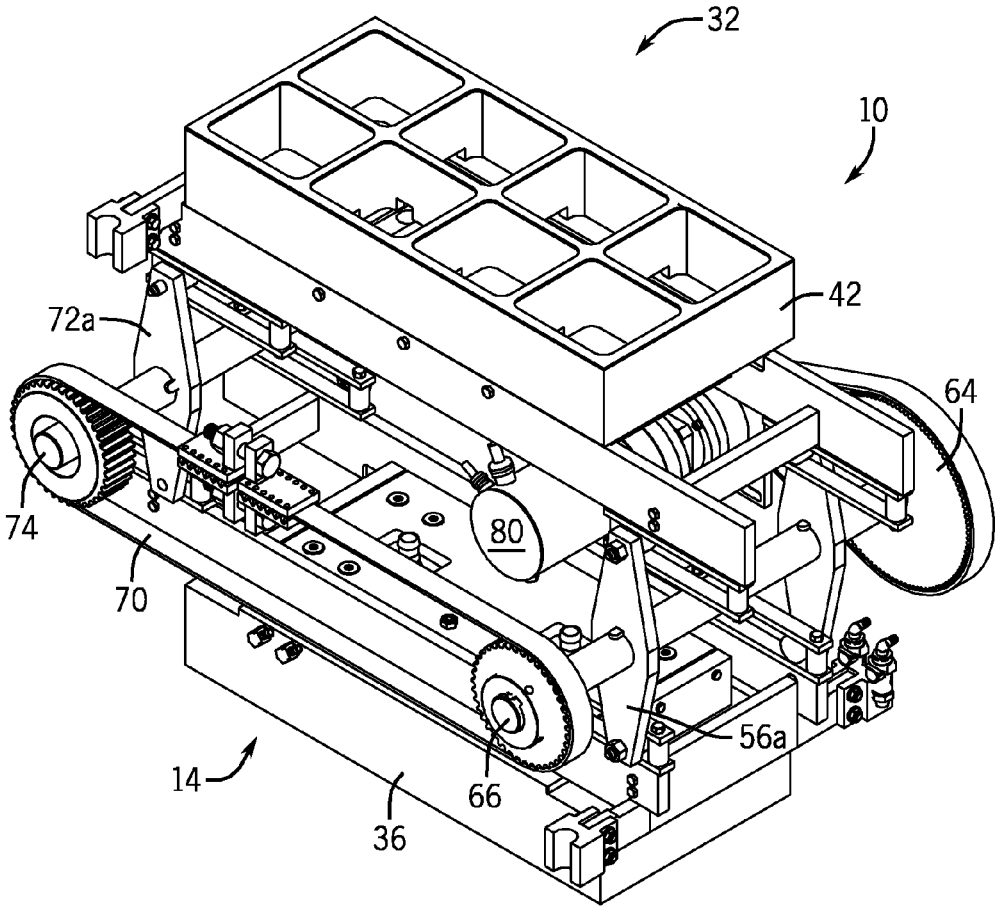
FIG. 16 is a perspective view of movable forming and sealing die members supported on a lift.
Figure 17:
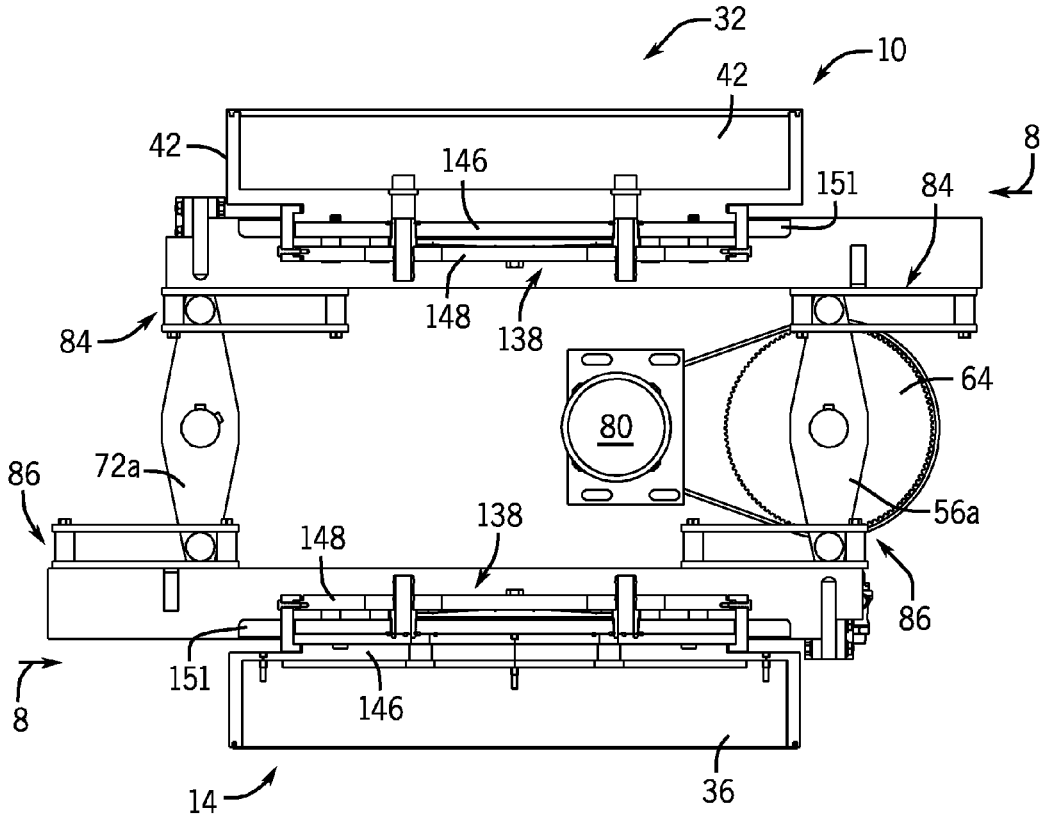
FIG. 17 is a sectional side view of the apparatus depicted in FIG. 16.

FIGS. 15-21 depict further embodiments of the packaging apparatus 32. As shown in FIGS. 16 and 17, a base 138 supports movement of the forming die member 36 between the noted first, open position in which the forming die member 36 is moved away from the web 6 of packaging material and the second, closed position in which the forming die member 36 engages the web 6 and assists in forming at least one pocket in the web 6. In the same way, a base 138 supports movement of the closing die member 42 between the noted open position in which the closing die member 42 is moved away from the web 6 and the closed position in which the closing die member 42 engages the web 6 and assists in closing the web 6 with the web 16. As shown in FIG. 15, each of the forming die member 36 and closing die member 42 are also movable into third, extracted positions shown in FIG. 15 along a direction shown by arrow 140, transverse to the movement of the die members 36, 42 between the open and closed positions (shown in FIGS. 6 and 7). Similar to the arrangements described in U.S. Pat. No. 7,340,871, forming die member 36 and closing die member 42 are typically moved into the noted extracted positions to enable tooling change or repair.

Figure 3:
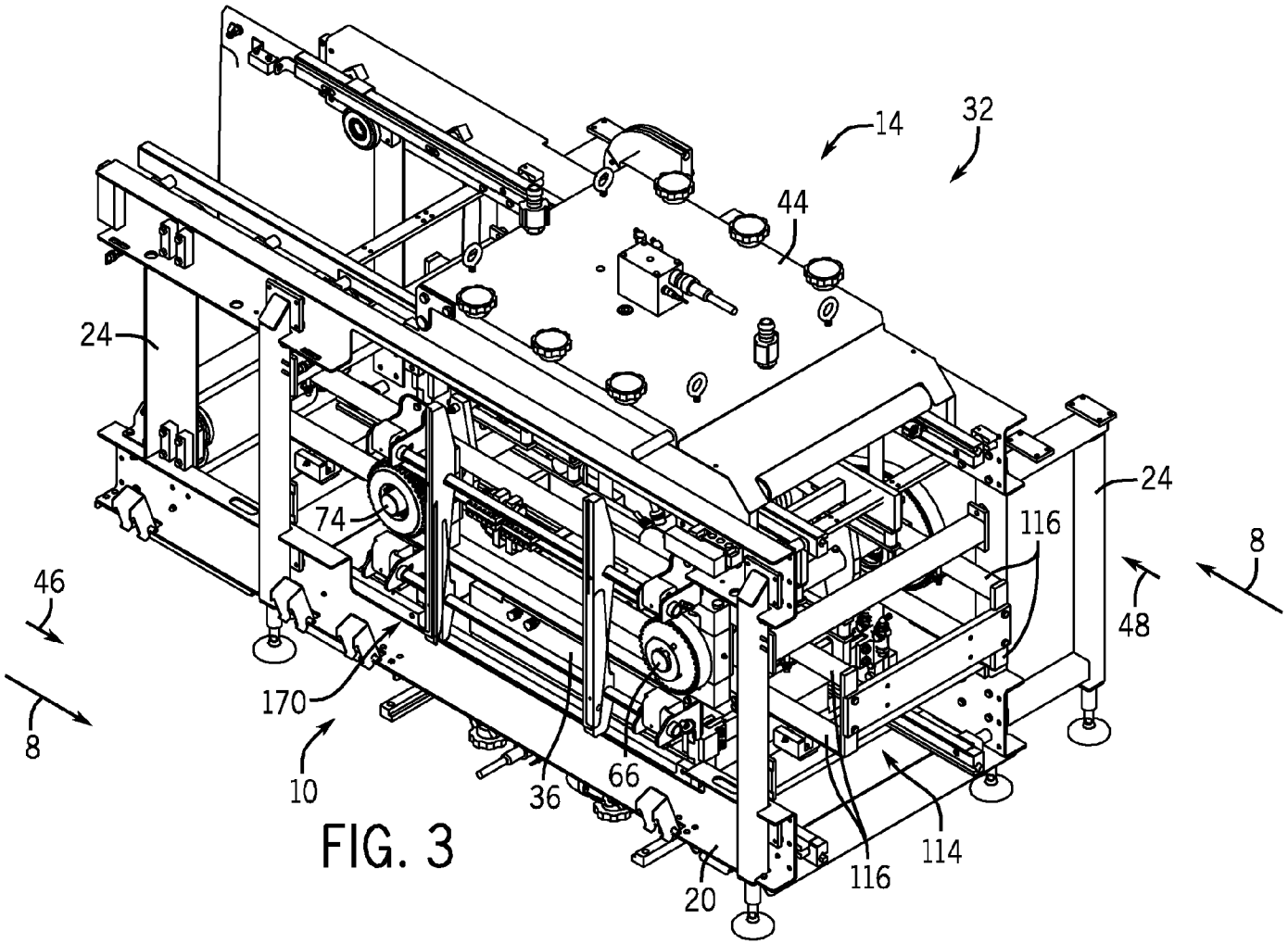
FIG. 3 is a perspective view of packaging apparatus incorporated into the machine depicted in FIG. 1, including forming and closing stations.
Figure 4:
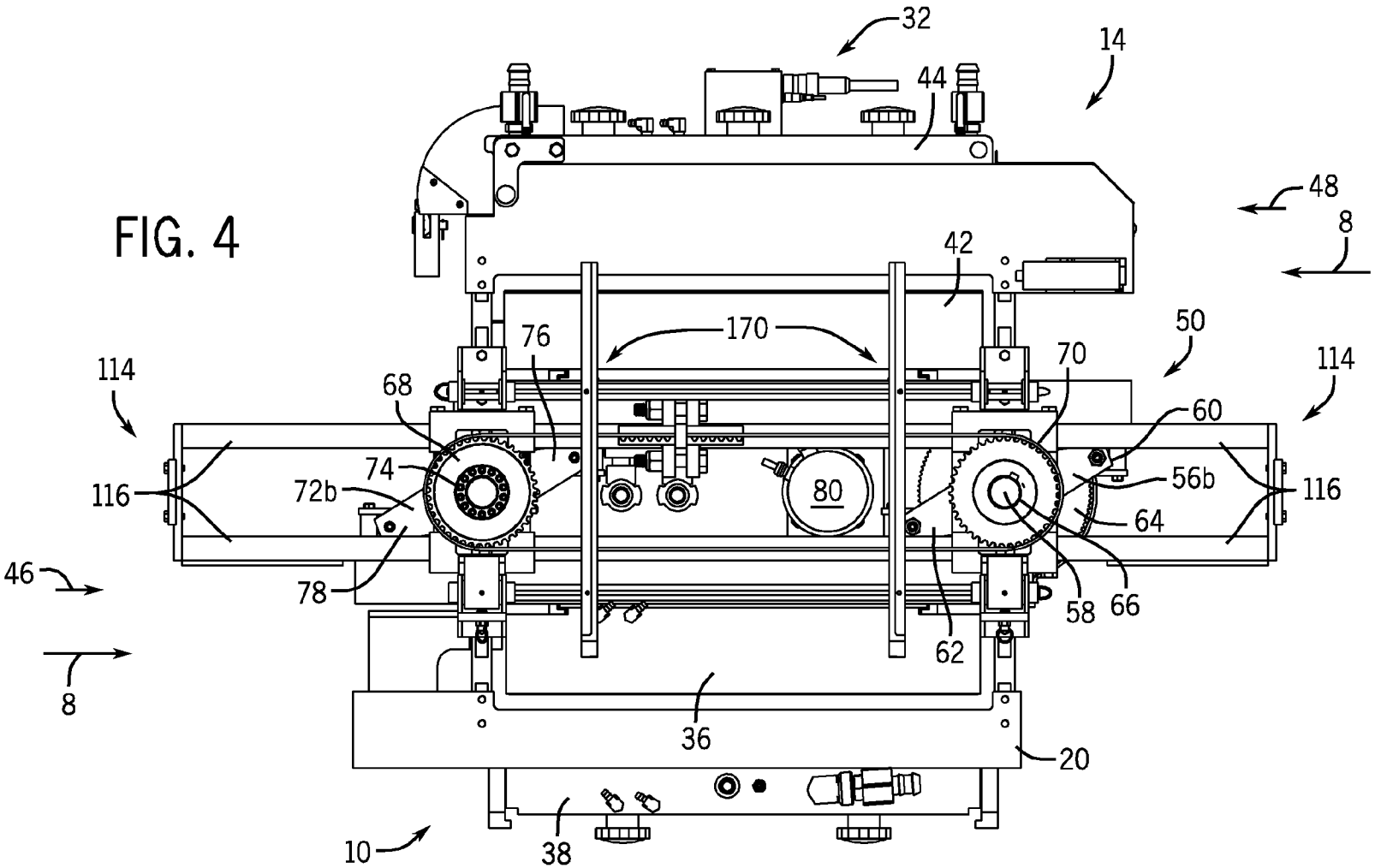
FIG. 4 is a side view of the apparatus depicted in FIG. 3.
Figure 5:
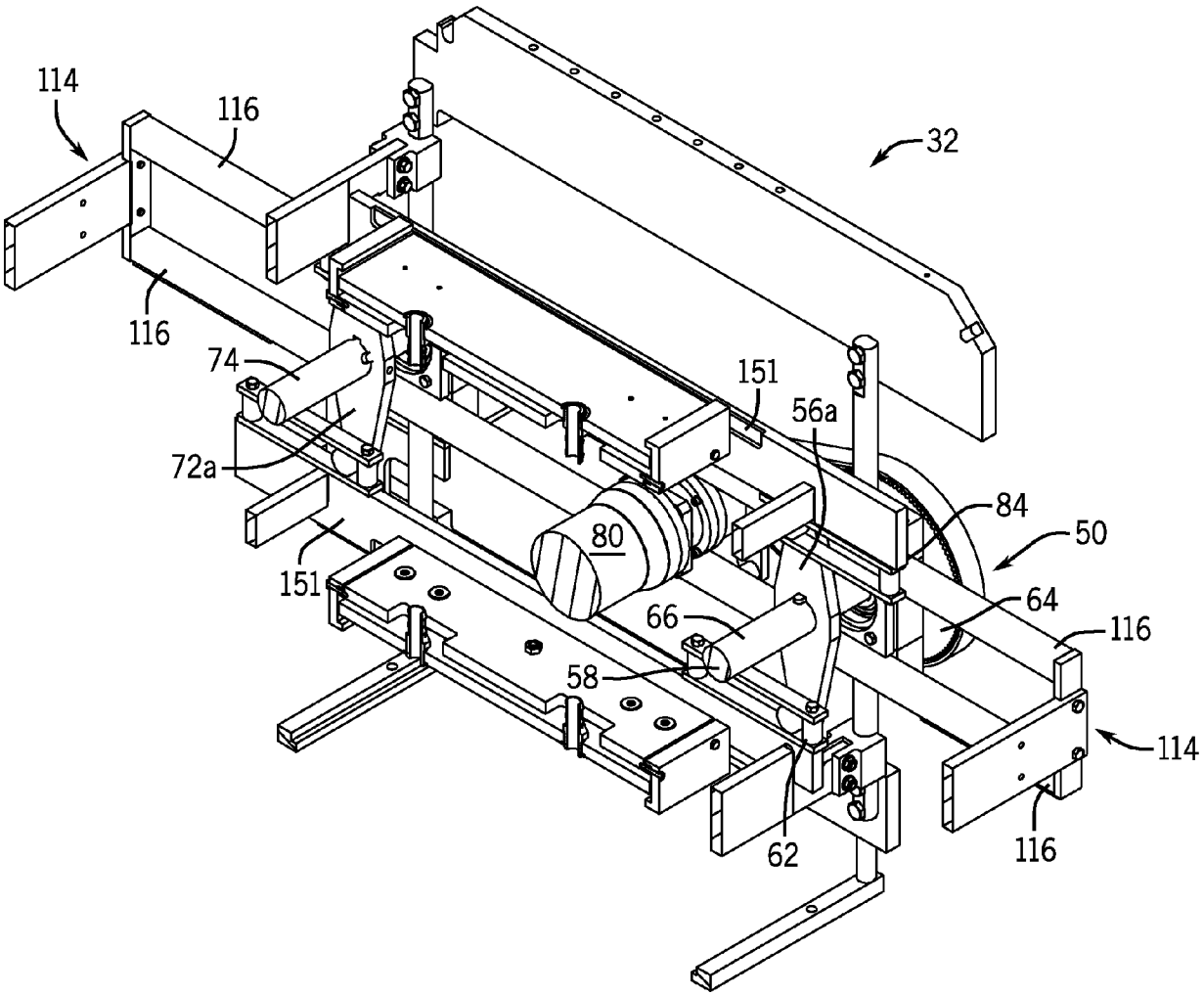
FIG. 5 is a perspective sectional view of the apparatus of FIG. 4.

As shown in FIG. 15, a guide track assembly 170 extends laterally of the base 138 and supports the closing die member 42 and the forming die member 36 during movement into the noted third positions. FIGS. 3 and 4 show perspective views of the assembly 170 in a retracted position, pivoted inwardly against the exterior of machine 2. Assembly 170 includes rails 172 for supporting movement of the base 138 and closing die member 44 into the noted third, extracted position shown in FIG. 15. In addition, rails 174 engage with the forming die member 36 to support the forming die member 36 against the force of gravity in the depicted inverted position. In the example shown, the rails 174 are spaced apart and include channels 176 sized to slideably mate with the outer edges of base 138, thus facilitating movement into the noted third, extracted position.

The apparatus 32 can also be configured to facilitate registration and unregistration of the forming die member 36 into and out of the forming station 10 and to facilitate registration and unregistration of the closing die member 42 into and out of the closing station 14, when movement into the respective extracted positions is desired. For brevity, the following description and related figures discusses the structures for assisting registration and unregistration of the closing die member 42. However it should be recognized that the same or similar structures are also provided for the forming die member 36, which in the embodiment shown would be inverted with respect to that shown for the closing die member 36.

Figure 18A:
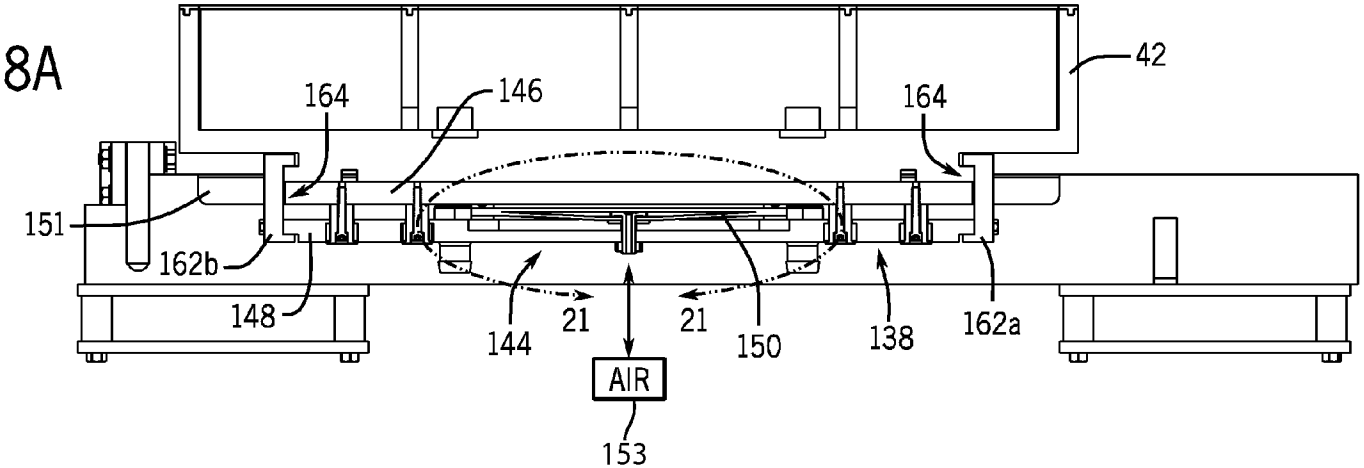
FIG. 18A is a sectional side view of a forming station including a lift supporting a base in an unregistered position.

Referring to FIGS. 18-21, the base 138 and closing die member 42 are normally in a registered position shown in FIG. 18A, wherein the closing die member 42 is prevented from moving out of the closing station 14 into the extracted position shown in FIG. 15. To enable tooling change, a second lift 144 is selectively operable to move the base 138 into an unregistered position shown in FIG. 18B, wherein the closing die member 2 is free to move outwardly into the extracted position. The base 138 and second lift 144 can include various structural connections for accomplishing the above noted functionality. In the embodiment shown, the base 138 includes top and bottom parts 146, 148 that are apart from each other in the registered position shown in FIG. 18A. In the example shown, the top and bottom parts 146, 148 are plates that are biased together by a plurality of springs 152 into the noted unregistered position shown in FIG. 18B. However other suitable support structures could be employed instead of plates for performing the noted function.

Figure 20:
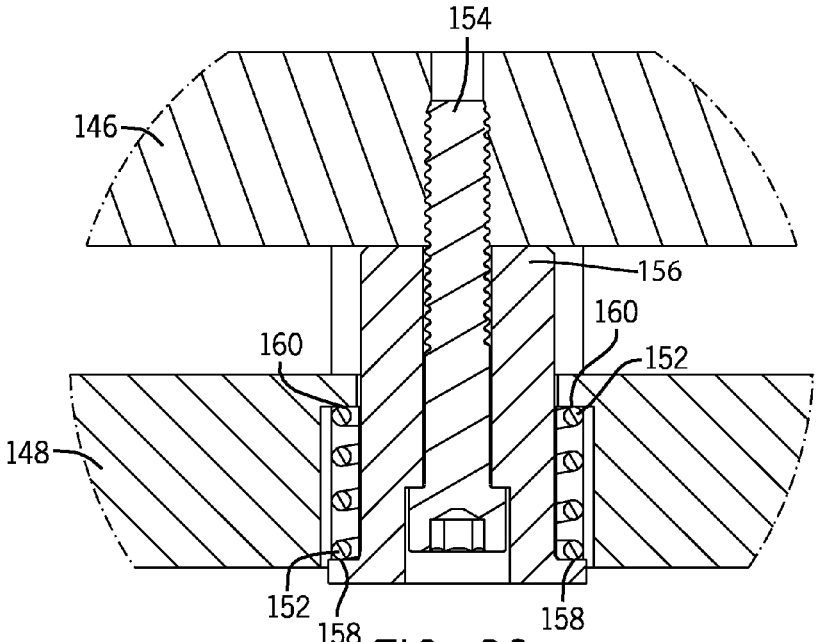
FIG. 20 is a sectional side view of a spring biasing a top part of the base towards a bottom part of the base into the registered position.
Figure 21:
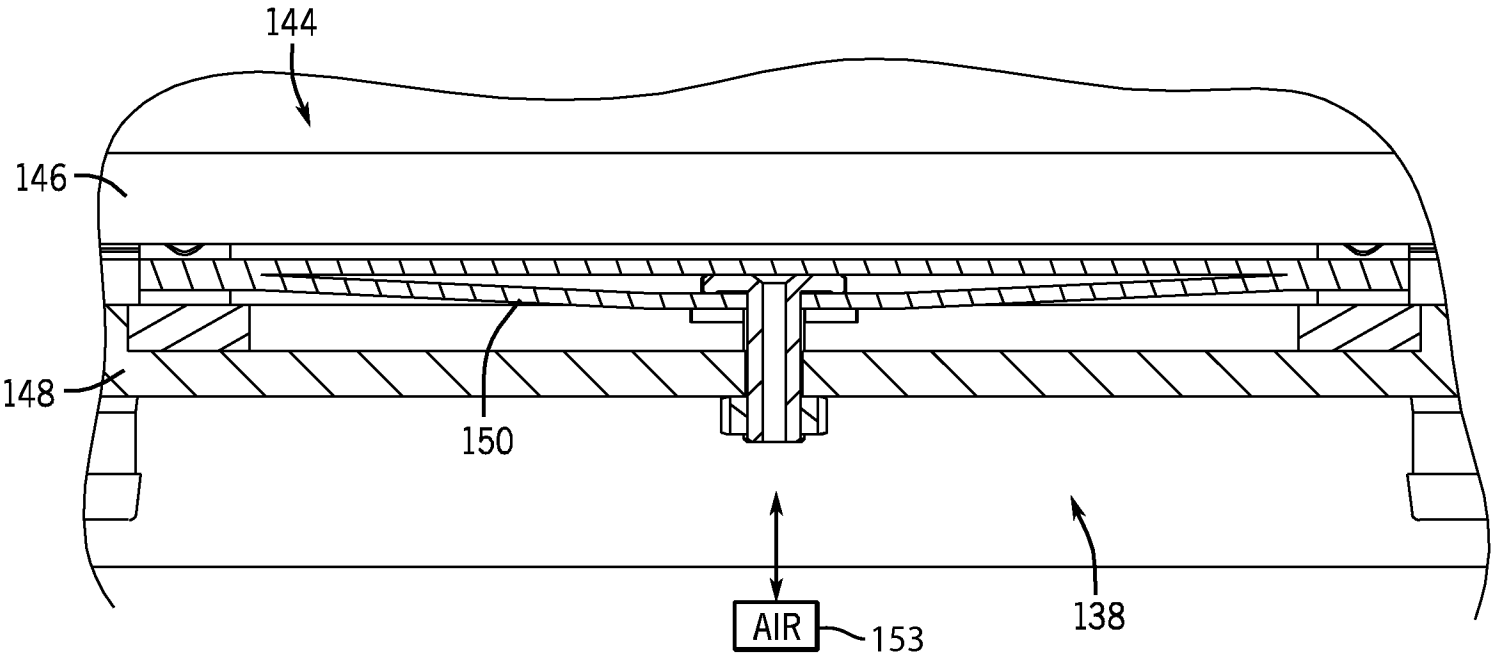
FIG. 21 is a sectional side view of the lift depicted in FIGS. 18A and 18B.

FIG. 20 depicts an example of a spring 152 for providing the noted bias. A bolt 154 is connected to the top part 146. The bolt 154 is also connected to a bushing 156 having flange surfaces 158. Spring 152 applies outwardly compressive force on the flange surfaces 158 of the bushing 156 and on an inner flange surface 160 on the bottom part 148 of base 138. By pushing the flange surfaces 158, 160 apart, the spring 152 biases the bottom part 148 towards the top part 146 to move the first movable closing die member 42 upward into the unregistered position, shown in FIG. 18B.

Figure 18B:
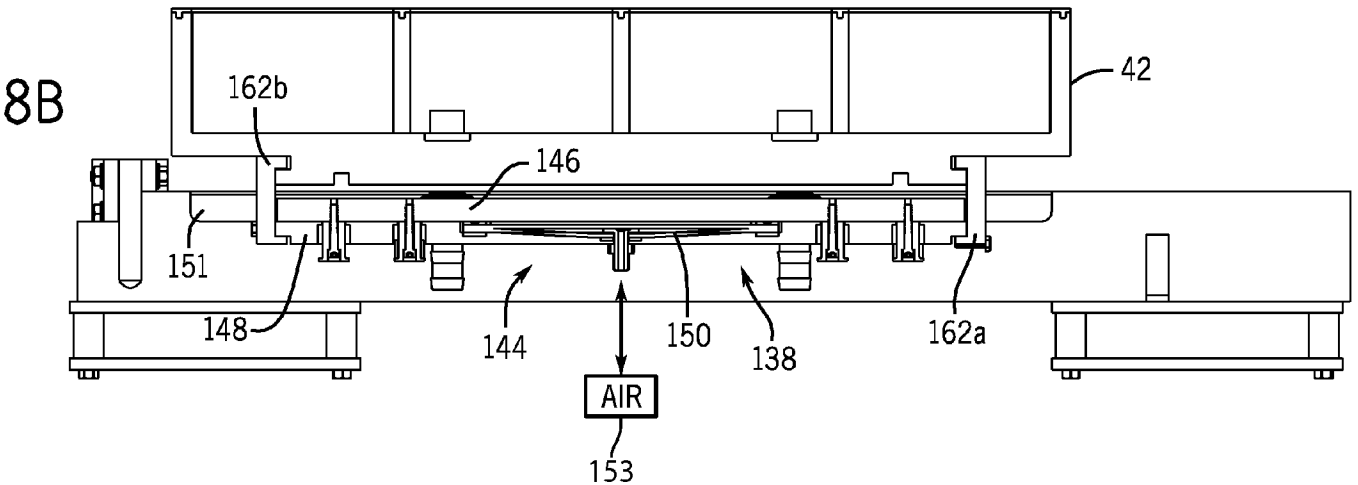
FIG. 18B is a sectional side view of the lift depicted in FIG. 18A, wherein the base is moved into a registered position.
Figure 19:
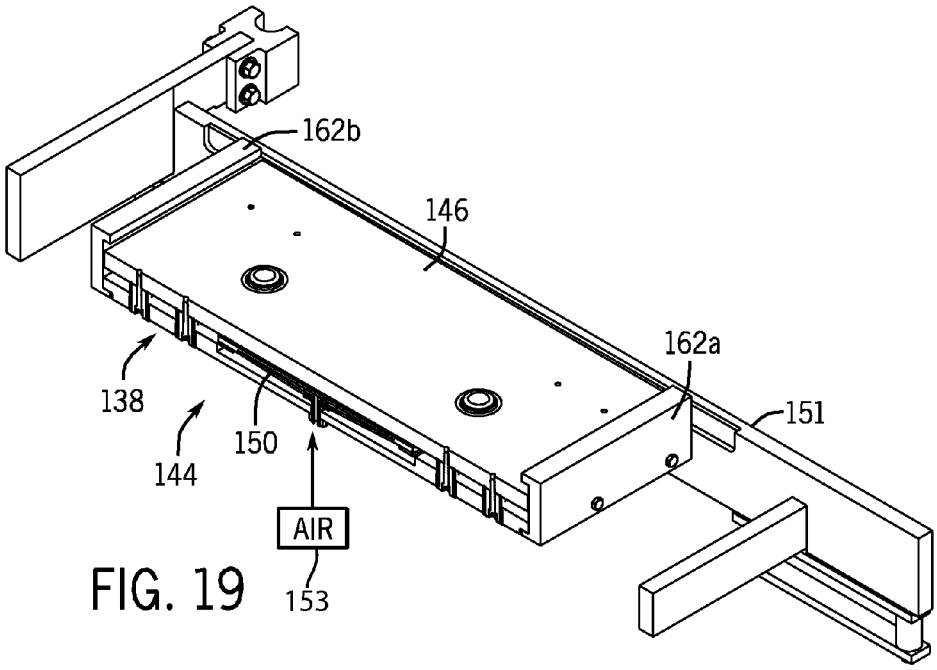
FIG. 19 is a sectional perspective view of the lift depicted in FIGS. 18A and 18B.

Referring to FIGS. 18A, 18B and 19, opposing side rails 162*a*, 162*b* that are C-shaped in cross section to define an inner channel 164 are provided on opposing sides of the top and bottom parts 146, 148. The side rails 162*a*, 162*b* are fixed at one (lower) end to the bottom part 148 of the base 138 and at the other (upper) end to the first movable closing die member 42. The top part 146 of the base 138 is fixed to the apparatus 32. The side rails 162*a*, 162*b* guide movement of the bottom part 148 to move the movable closing die member 42 between the noted registered and unregistered positions. When the bottom part 148 of the base 138 is in the registered position, a packaging machine frame element 151 prevents movement of the movable closing die member 42 into the extracted position shown in FIG. 15. When the bottom part 148 of the base 138 is in the unregistered position, the package machine frame element 151 does not prevent movement of the moveable closing die member 42 into the extracted position shown in FIG. 15. In the embodiment shown, the packaging machine frame element 151 includes a side rail on the machine 2.

In the embodiment shown, the second lift 144 includes a bladder 150 disposed between the upper and lower parts 146, 148 and placed in communication with a source of pressurized air 153. Adding pressurized air to the bladder 150 inflates and therefore expands the bladder 150. The outer surfaces of the bladder 150 thus push the bottom part 148 away from the top part 146 and into the registered position shown in FIG. 18A. Evacuating pressurized air from the bladder 150 deflates and therefore contracts the bladder 150, which releases pressure from the parts 146, 148 and allows the bottom part 148 to be biased into the unregistered position. Although the second lift 144 in the present embodiment includes a bladder 150, it will be recognized that the lift could include different mechanisms for moving the base 138 and associated die member 36, 42 into and out of the registered and unregistered positions.

Packaging apparatus 32 is thus provided that includes a plurality of springs 152 biasing the bottom part 148 of the base 138 into the noted unregistered position, wherein the lift includes a bladder 150 that inflates to move the bottom part 148 of the base 138 into the registered position, and deflates to allow the bottom part 148 to be biased into the unregistered position. In this manner, the movable first closing die member 42 is movable into the extracted position shown in FIG. 15, while the web 6 remains uncut and in place. This same principle also applies to the movable first forming die member 36, as discussed above.

Alternative arrangements for facilitating registration and unregistration of the forming die member 36 and closing die member 42 are contemplated. For example, instead of providing the second lift 144 to move the respective die members 36, 42 vertically in the apparatus 32 to clear the frame element 151, apparatus 32 could include a lift mechanism that moves the frame element 151 while the die members 36, 42 remain stationary. This would accomplish the same functionality of registration and unregistration of the die members 36, 42 to allow for movement into the noted extracted positions. Alternatively, the lift could be configured to move both of the die members 36, 42 and the frame element 151 to achieve the requisite clearance to allow movement into the extracted positions. The effect of these embodiments is thus to allow for registration and unregistration of the die members to prevent and allow movement into the extracted positions, respectively.

What is claimed is:

1. A packaging apparatus for an indexing-motion packaging machine, the machine comprising a web transport conveyor transporting a first web of flexible packaging material along a direction of transport from upstream to downstream locations through a series of stations for forming at least one pocket in the first web, placing food product in the at least one pocket, and closing the pocket with an second web of packaging material; the packaging apparatus comprising:

a forming station comprising first and second forming die members, at least one of the first and second forming die members being movable between first, open position relative to the other one of the first and second forming die members in which position the movable forming die member is moved away from the first web, and a second, closed position relative to the other one of the first and second forming die members in which position the movable forming die member engages the first web and assists in forming the first web into the pocket;

wherein the movable forming die member is movable into a third, extracted position along a direction transverse to the direction of movement of the movable forming die member between the first, open and second, closed positions and transverse to the direction of transport of the first web, the movable forming die member being moved to said third, extracted position to enable tooling change; and a lift that is selectively operable to register and unregister the movable forming die member in the packaging apparatus;

wherein when registered, the movable forming die member is prevented from moving from the first, open position into the third, extracted position and wherein when unregistered, the movable forming die member is free to move from the first, open position into the third, extracted position;

wherein the lift is configured to move the movable forming die member between a registered position and an unregistered position;

comprising a base supporting movement of the movable forming die member between the first, open position and the second, closed position;

wherein the base comprises top and bottom parts that are biased together to position the movable forming die member into the unregistered position and wherein actuation of the lift moves the bottom part away from the top part to move the base and the movable forming die member into the registered position.

2. The packaging apparatus according to claim 1, wherein the lift comprises a bladder that deflates to allow the bottom part of the base to move into the unregistered position and inflates to move the bottom part into the registered position.

3. The packaging apparatus according to claim 1, wherein the lift comprises at least one spring biasing the bottom part towards the top part into the unregistered position.

4. The packaging apparatus according to claim 1, wherein the top and bottom parts comprise plates.

5. The packaging apparatus according to claim 1, comprising at least one side rail supporting movement of the bottom part.

6. The packaging apparatus according to claim 1, wherein the lift comprises at least one spring biasing the bottom part towards the top part to thereby move the movable forming die member into the unregistered position, wherein the lift comprises a bladder that inflates to move the bottom part of the base to thereby move the movable forming die member into the registered position and deflates to allow the bottom part to be biased into the unregistered position.

7. A packaging apparatus for an indexing-motion packaging machine, the machine comprising a web transport conveyor transporting a first web of flexible packaging material along a direction of transport from upstream to downstream locations through a series of stations for forming at least one pocket in the first web, placing food product in the at least one pocket, and closing the pocket with an second web of packaging material; the packaging apparatus comprising:

a closing station comprising first and second closing die members, at least one of the first and second closing die members being movable between first, open position relative to the other one of the first and second closing die members in which position the movable closing die member is moved away from the first web and a second, closed position relative to the other one of the first and second closing die members in which position the movable closing die member engages the first web and assists in closing the pocket;

wherein the movable closing die member is movable into a third, extracted position along direction transverse to the direction of movement of the movable closing die member between the first, open and second, closed positions and transverse to the direction of transport of the first web, the movable closing die member being moved to said third, extracted position to enable tooling change; and a lift that is selectively operable to register and unregister the movable closing die member in the packaging apparatus;

wherein when registered, the movable closing die member is prevented from moving from the first, open position into the third, extracted position and wherein when unregistered, the movable closing die member is free to move from the first, open position into the third, extracted position;

wherein the lift is configured to move the movable closing die member between a registered position and an unregistered position;

comprising a base supporting movement of the movable closing die member between the first, open position and the second, closed position;

wherein the base comprises top and bottom parts that are biased together to position the movable closing die member into the unregistered position and wherein actuation of the lift moves the bottom part away from the top part to move the base and the movable closing die member into the registered position.

8. The packaging apparatus according to claim 7, wherein the lift comprises a bladder that deflates to allow the bottom part of the base to move into the unregistered position and inflates to move the bottom part into the registered position.

9. The packaging apparatus according to claim 7, wherein the lift comprises at least one spring biasing the bottom part towards the bottom part into the unregistered position.

10. The packaging apparatus according to claim 7, wherein the top and bottom parts comprise plates.

11. The packaging apparatus according to claim 7, comprising at least one side rail supporting movement of the bottom part.

12. The packaging apparatus according to claim 7, wherein the lift comprises at least one spring biasing the bottom part towards the top part to thereby move the movable closing die member into the unregistered position, wherein the lift comprises a bladder that inflates to move the bottom part of the base to thereby move the movable closing die member into the registered position and deflates to allow the bottom part to be biased into the unregistered position.

* * * * *